US009266159B2

(12) United States Patent
Wooters

(10) Patent No.: US 9,266,159 B2
(45) Date of Patent: Feb. 23, 2016

(54) VENETIAN BLIND REPAIR TOOL

(76) Inventor: Chad Wooters, Lombard, IL (US)

( * ) Notice: Subject to any disclaimer, the term of this patent is extended or adjusted under 35 U.S.C. 154(b) by 1153 days.

(21) Appl. No.: 13/196,638

(22) Filed: Aug. 2, 2011

(65) Prior Publication Data

US 2013/0031946 A1 Feb. 7, 2013

(51) Int. Cl.
*B21D 1/10* (2006.01)

(52) U.S. Cl.
CPC ..... *B21D 1/10* (2013.01)

(58) Field of Classification Search
CPC ..... B21D 1/10; B21D 5/002; B21D 5/02; B21D 5/04; B21D 7/10; B21D 11/10; B21D 19/08
USPC ..... 72/316, 309, 296, 470, 474, 476, 373, 72/376, 389.1, 386, 389.2, 389.3, 31.02, 72/31.1, 31.11, 31.12; 81/463, 487; 254/249, 43, 246, 95; 29/3, 249, 43, 29/246
See application file for complete search history.

(56) References Cited

U.S. PATENT DOCUMENTS 1,490,772 A 4/1924 Gunn
3,136,357 A * 6/1964 Lorentzen et al. ..... 160/178.1
3,145,758 A 8/1964 Sprung et al.
4,450,701 A 5/1984 Treiber et al.
4,491,261 A * 1/1985 Mitsuhashi ..... 227/76
4,499,938 A 2/1985 Toti
4,643,016 A * 2/1987 Barberine et al. ..... 72/387
5,458,939 A 10/1995 Kitchen
6,393,884 B1 5/2002 Berntsson et al.
6,644,160 B1 11/2003 Boselli
7,461,440 B2 12/2008 Sasaki et al.

FOREIGN PATENT DOCUMENTS

JP 2002276267 A * 9/2002

* cited by examiner

*Primary Examiner* — Shelley Self
*Assistant Examiner* — Pradeep C Battula
(74) *Attorney, Agent, or Firm* — Erickson Law Group, PC

(57) ABSTRACT

A tool for repairing a Venetian blind by reintroducing a curvature into the Venetian blind is disclosed. The tool has a cradling member and a receiving member. The cradling member has a base and a first stop wall. The first stop wall is joined with the base and extends upward from a base surface. The receiving member has a second stop wall. The second stop wall is located adjacent to the base. The second stop wall is opposite of the first stop wall. The cradling member or the receiving member is slidable relative to the other of the cradling member or the receiving member for compressing the Venetian blind between the first stop wall and the second stop wall by varying a distance between the first stop wall and the second stop wall.

16 Claims, 4 Drawing Sheets

VENETIAN BLIND REPAIR TOOL

FIELD OF THE INVENTION

This invention relates to the field of repair solutions for Venetian blinds.

BACKGROUND OF THE INVENTION

Venetian blinds comprise thin slats which are often made from metal. Damage, such as bending the slats out of shape, frequently occurs during the normal course of use. Slats may be damaged by repeated use, or by accidental compression, such as during cleaning. Current repair solutions for Venetian blind slats include attempting to bend the slats back by hand without the assistance of a tool, or by disassembling the blind to replace the damaged slats. Each of these solutions is disadvantageous for various reasons. Hand bending the slats in an attempt to match the original curvature or the undamaged portion often results in uneven and off-center bends, which can cause more damage to the blinds. Replacing the damaged slats can be time consuming and results may not be satisfactory since the new slats may not match the color of the original slats which have faded over time. As a result, replacing the entire set of Venetian blinds is often the most effective solution. However, replacing the entire set of Venetian blinds is not a cost effective solution.

The present inventor has recognized the need for a tool for repairing Venetian blinds.

The present inventor has recognized the need for an easy to use tool for reintroducing a curvature to the Venetian blind.

SUMMARY OF THE INVENTION

A tool for reintroducing a curvature into a Venetian blind is disclosed. The tool comprises a cradling member and a receiving member.

In one embodiment, the cradling member comprises a base and a first stop wall. The base comprises a base surface for supporting the Venetian blind. The first stop wall is joined with the base and extends upward from the base surface.

The receiving member comprises a second stop wall. The second stop wall is located adjacent to the base. The second stop wall is opposite of the first stop wall.

The base comprises an elongated protrusion extending above the base surface and located between the first stop wall and the second stop wall.

The first stop wall, the second stop wall, and the elongated protrusion are each longitudinally oriented relative to a transverse length of the base. The elongated protrusion is spaced apart from the first stop wall.

The cradling member or the receiving member is slidable relative to the other of the cradling member or the receiving member for compressing the Venetian blind between the first stop wall and the second stop wall by varying a distance between the first stop wall and the second stop wall.

Numerous other advantages and features of the present invention will become readily apparent from the following detailed description of the invention and the embodiments thereof, from the claims and from the accompanying drawings.

DETAILED DESCRIPTION

Figure 1:
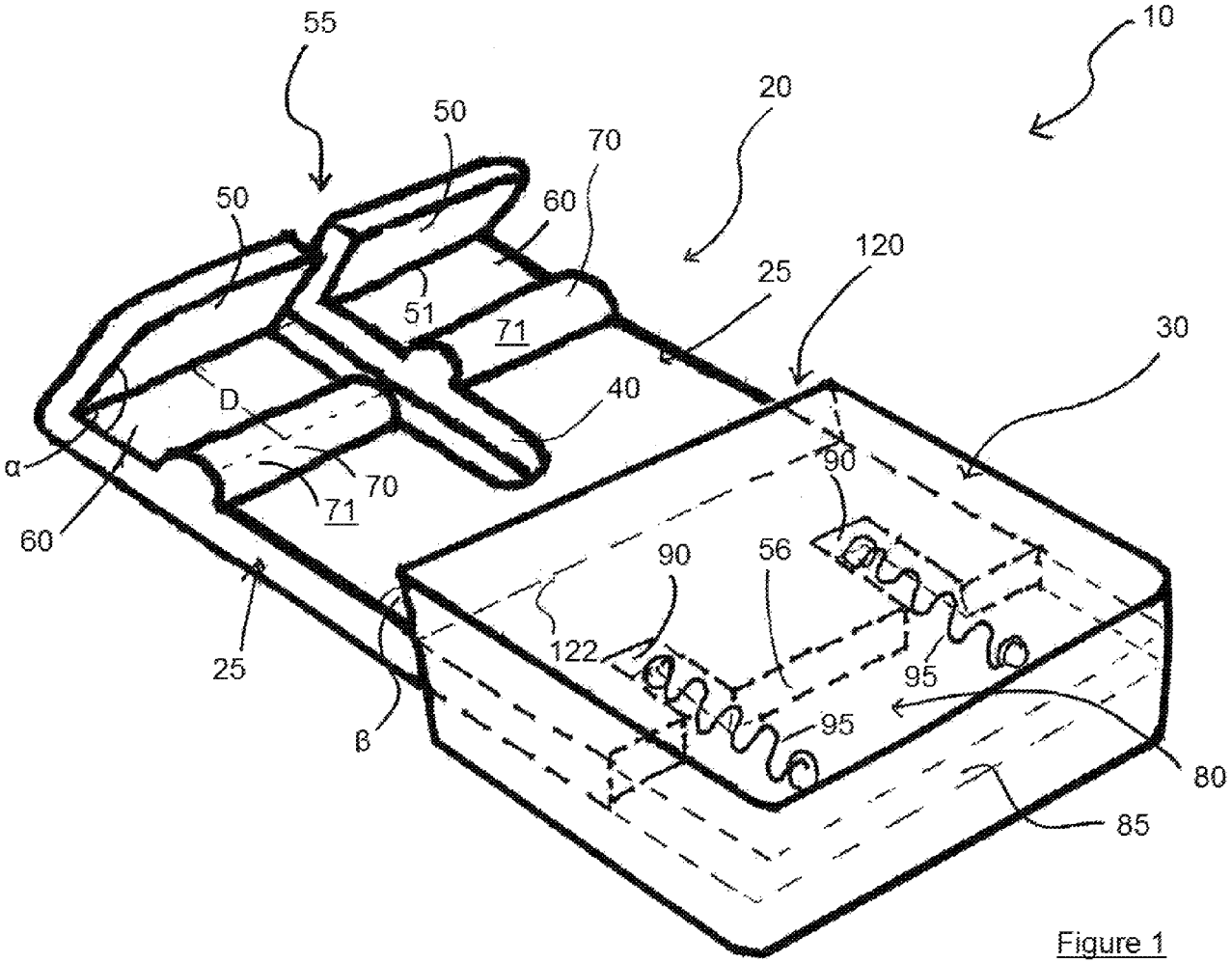
FIG. 1 is a perspective view of one exemplary embodiment of a blind repair tool of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
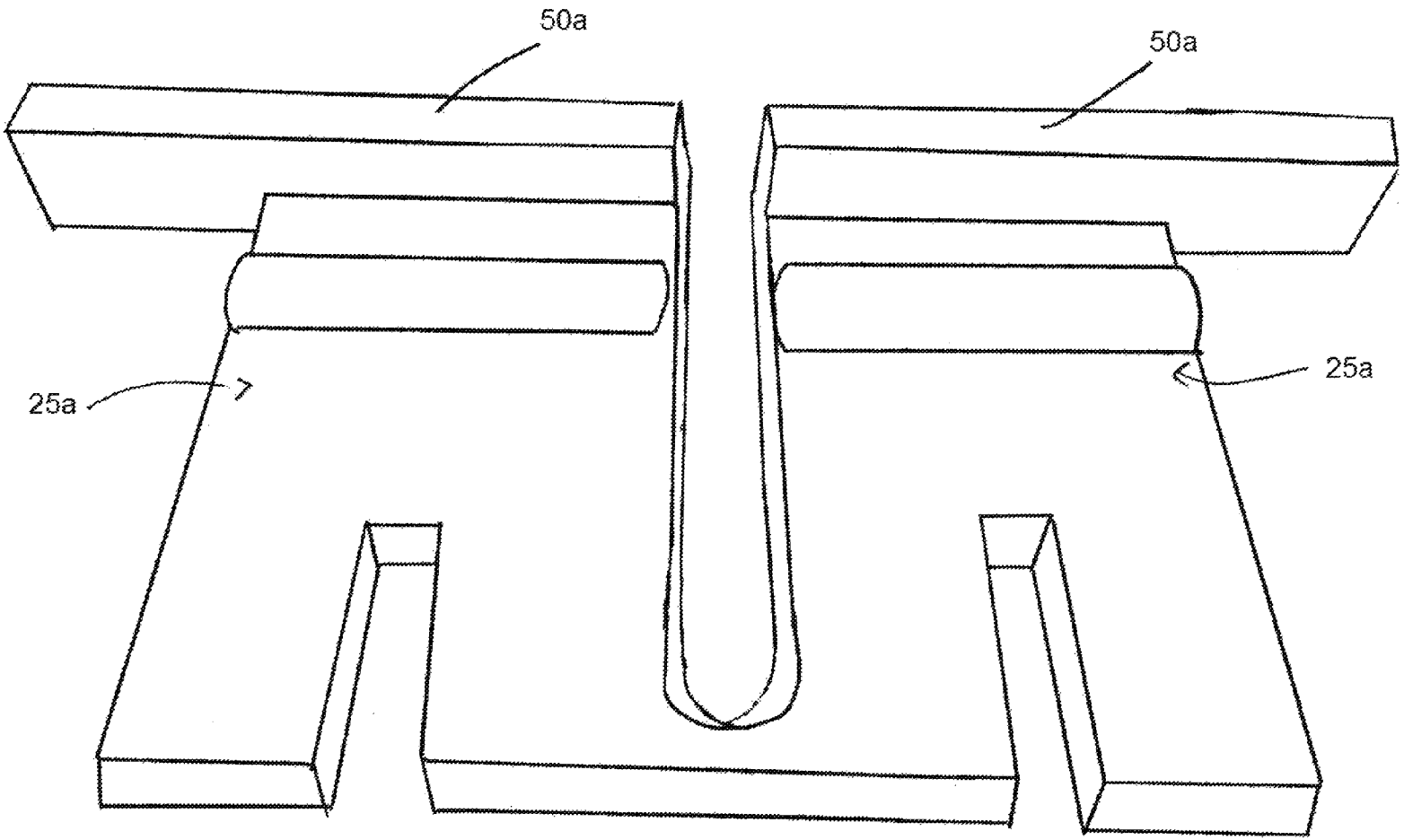
FIG. 2 is a perspective view of one exemplary embodiment of a cradling member of the tool of FIG. 1.

FIG. 1 illustrates a perspective view of the blind repair tool 10. The blind repair tool comprises a cradling member 20 and a receiving member 30 which move relative to each other. The cradling member comprises two arms 25 separated by a slot 40. A first wall or extended ledge 50 which forms an inwardly bent L-shape at the front end 55 of the cradling member extends upwards from the base 60 of the cradling member. In the embodiment show in FIG. 1, ledge 50 extends from the base at an angle "α" The extended ledge 50 intersects the base 60 at a straight edge 51. As illustrated in FIG. 1, angle "α" is less than 90 degrees, and is tilted towards the back end 56 of the cradling member. In another embodiment illustrated in FIG. 2, the ledge 50*a* extends laterally past the width of the prongs 25*a*. In another embodiment, the ledge can extend at an angle 90 degrees or greater from the base 60 of the cradling member.

Figure 3:
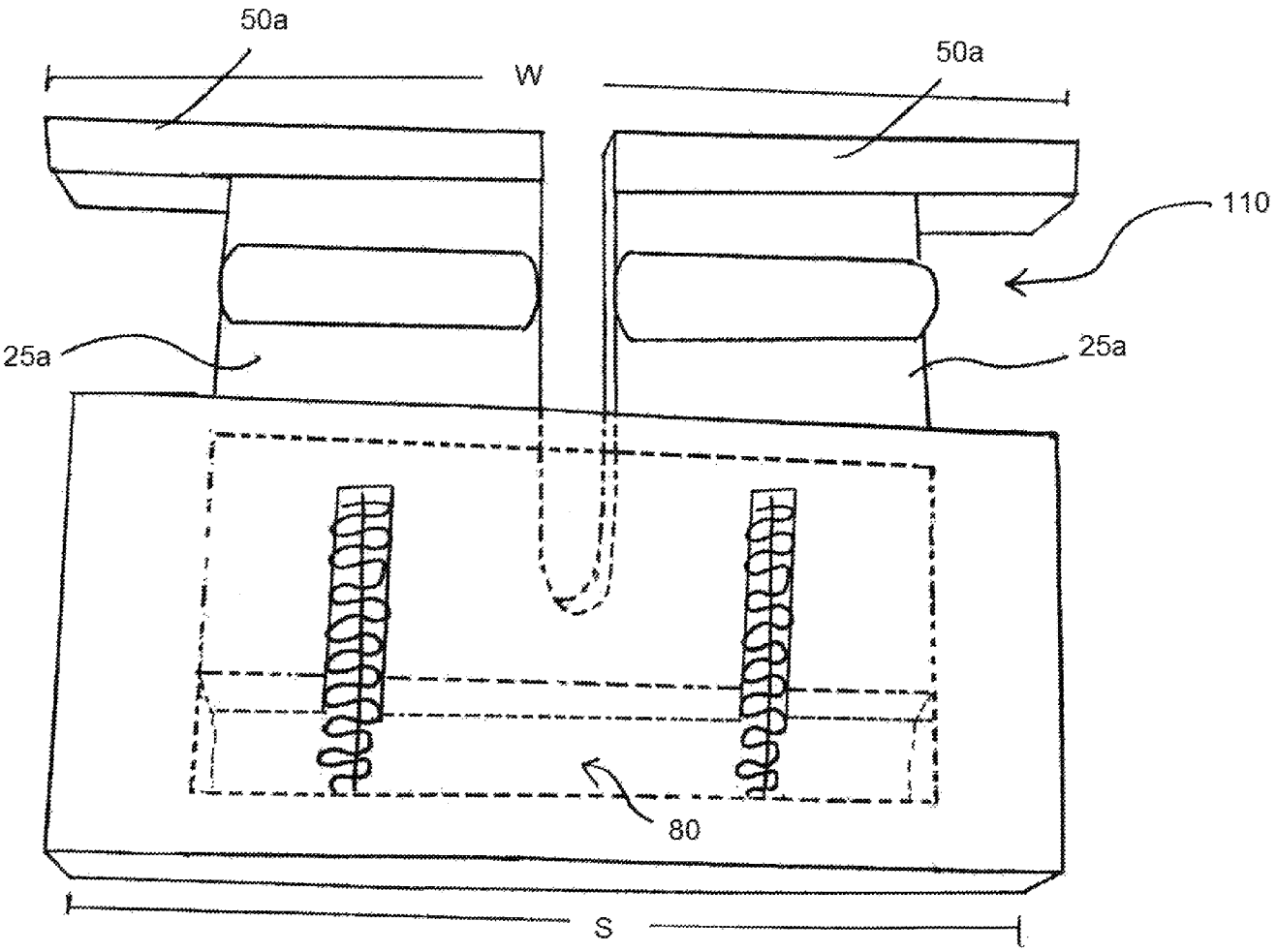
FIG. 3 is a perspective view of an alternate embodiment blind repair tool.
Figure 4:
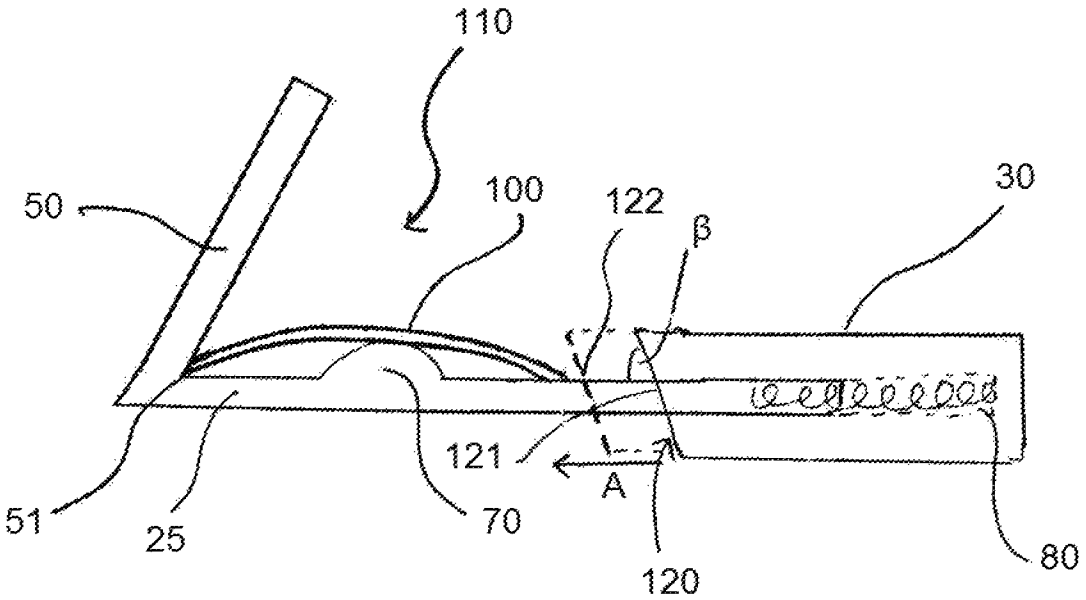
FIG. 4 is a side view of the tool in use with a Venetian blind portion.

The prongs 25 each comprise a protrusion 70 for supporting a portion of the Venetian blind within the curve forming region 110 (FIGS. 3 and 4). In the embodiment shown, the protrusion 70 has a rounded surface 71. In one embodiment, the protrusion is semi-cylindrical. The central axis of the semi-cylinder is located at distance D from the edge wherein the ledge 50 extends from the base. In one embodiment distance D is half the width of the Venetian blind slat being repaired. For wider slats, distance D is greater. In other embodiments, the protrusion need not have a cross sectional area that is half the area of a circle, and can have a cross-sectional area that is greater or less than a semi-circle. Any other suitable shape for the protrusion can be used.

The back end 56 of the cradling member 20 is received within the receiving member 30. The receiving member 30 comprises a recessed region 80 (shown in dashed lines in FIGS. 1 and 3), or pocket shaped to receive the back end 56 of the cradling member. In the embodiment illustrated in FIG. 1, the back end 56 of the cradling member has two spring receiving slots 90 to receive springs 95. Springs 95 can be tension springs which allow for the cradling member and receiving member to be biased towards an extended position wherein the back end 56 of the cradling member 20 is not in contact with the end 85 of the recessed region 80. Any other method of engaging a spring mechanism between the cradling member and the receiving member can also be used. Any other mechanism for returning the cradling member and the receiving member into an extended position can also be used. In other embodiments, the cradling member is disposed beneath the receiving member while the receiving member moves along the top surface of the cradling member without comprising a recessed region which engages with the back end of the cradling member.

In one embodiment, the receiving member 30 has a second stop wall or leading edge 120 with an angled surface 121. As illustrated in FIGS. 1 and 4, the angled surface 121 intersects with the base 60 of the cradling member 20 at an angle "β". Angle "β" as illustrated in FIG. 4, can be less than 90 degrees. In other embodiments, β may be 90 degrees or greater. In some embodiments, angles "α" and "β" are equal. The angled surface 121 contacts the base 60 at a straight edge 122. In one embodiment, straight edge 122 and straight edge 51 are parallel and on opposite sides of the protrusion 70.

In use, the user places a portion of the Venetian blind 100 for which repair is desired across prongs 25. The user aligns one edge of the Venetian blind against the straight edge 51 formed by the intersection of the extended ledge 50 and the base 60, such that a central portion of the Venetian blind 100 is disposed over the protrusion 70 within the curve forming region 110 (FIG. 4). To generate a bend in the Venetian blind, the receiving member is moved towards the Venetian blind in a direction "A" as indicated by the arrow in FIG. 4, to pinch the edges of the Venetian blind 100 towards each other to re-introduce a curvature to the Venetian blind. The Venetian blind as a result is pinched between the straight edge 122 formed by the intersection of the angled surface 121 and the base 60, and the straight edge 51 formed by the intersection of the extended ledge 50 and the base 60. Pressure from the receiving member is exerted as needed depending on the curvature desired, and the stiffness of the Venetian blind. Without wishing to be bound by any particular theory, it is believed that the force exerted on the Venetian blind edge as a result of the disposition of the Venetian blind between the extended ledge 50 and the angled surface 121 are more likely to be equal when the angles "α" and "β" are equal. The force actually exerted on the edges of the Venetian blind depends on the configuration or shape as a result of the extent of damage, of the venetian blind. The width "W" of the wingspan of the extended ledge 50*a* (FIG. 3) and the width "S" of the receiving member can be the same or different widths, depending on the desired mechanical dynamics for the particular size and type of Venetian blind, which can have a varying stiffness and/or thickness.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A tool for reintroducing a curvature into a venetian blind, comprising:

a cradling member comprising a base and a first stop wall, the base comprises a base surface for supporting the venetian blind;

the first stop wall is joined with the base and extends upward from the base surface;

a receiving member comprising a second stop wall, the second stop wall located adjacent to the base, the second stop wall is opposite the first stop wall;

the base comprises an elongated protrusion extending above the base surface and located between the first stop wall and the second stop wall;

the first stop wall, the second stop wall, and the elongated protrusion are each longitudinally oriented relative to a transverse length of the base, the elongated protrusion spaced apart from the first stop wall; and, the cradling member or the receiving member is slidable relative to the other of the cradling member or the receiving member for compressing the venetian blind between the first stop wall and the second stop wall by varying a distance between the first stop wall and the second stop wall.

2. The tool of claim 1, wherein the base comprises two arms and a transverse slot, the transverse slot separates the two arms, and wherein the first stop wall comprises two portions separated by the transverse slot.

3. The tool of claim 1, wherein the elongated protrusion is curved.

4. The tool of claim 1, comprising a spring, the spring positioned between the receiving member and the base to bias the base to an extended position.

5. The tool of claim 1, wherein a first acute angle is formed between the first stop wall and the base, and a second acute angle is formed between the second stop wall and the base.

6. The tool of claim 1, wherein the base comprises a distal end opposite the first stop wall, and the receiving member comprises a recessed region for receiving the distal end.

7. The tool of claim 1, wherein the receiving member is movable along the base surface of the base to vary the transverse length of the base that is located between the first stop wall and the second stop wall.

8. The tool of claim 1, wherein the first stop wall comprises a first width and the second stop wall comprises a second width, and the first width and the second width are equal.

9. The tool of claim 1, wherein the first stop wall comprises a first width and the second stop wall comprises a second width, and wherein the first width and the second width are not equal.

10. The tool of claim 1, wherein the receiving member comprises a receiving slot sized to receive at least a portion of the base, the base movable relative to the receiving slot for compressing the venetian blind between the first stop wall and the second stop wall by varying the distance between the first stop wall and the second stop wall.

11. The tool of claim 10, comprising a spring; the receiving slot comprises a rear wall and an entry opening, the rear wall is opposite the entry opening, the spring is positioned between a distal end of the base and the rear wall to bias the first stop wall away from the second stop wall, the distal end of the base is opposite the first stop wall.

12. The tool of claim 10, comprising a spring; the receiving slot comprises a rear wall and an entry opening, the rear wall is opposite the entry opening, the base comprises a distal end opposite the first stop wall, the distal end comprises a spring recess, the spring is positioned in the spring recess between a back wall of the spring recess and the rear wall to bias the first stop wall away from the second stop wall.

13. The tool of claim 1, wherein a first acute angle is formed between the first stop wall and the base, a second acute angle is formed between the second stop wall and the base, the first stop wall is angled toward the second stop wall, and the second stop wall is angled toward the first stop wall.

14. A tool for reintroducing a curvature into a venetian blind comprising:

a cradling member comprising a base and a first stop wall, the base comprises a base surface for supporting the venetian blind;

the first stop wall is joined with the base and extends upward from the base, a first acute angle is formed between the first stop wall and the base;

a receiving member comprising a receiving slot and a second stop wall, the receiving slot is open to the second stop wall, a second acute angle is formed between an upper portion of the second stop wall and the base, the second stop wall is adjacent the base;

the base comprises an elongated curved protrusion extending above the base surface, and located between the first stop wall and the second stop wall, and configured to be located under the venetian blind when the venetian blind is laid on the base surface between the first stop wall and the second stop wall;

the first stop wall, the second stop wall, and the elongated curved protrusion are each longitudinally oriented relative to a transverse length of the base;

the cradling member or the receiving member is movable relative to the other of the cradling member or the receiving member to compress the venetian blind at opposite edges of the venetian blind between the first stop wall and the second stop wall by varying a distance between the first stop wall and the second stop wall.

15. The tool of claim 14, wherein the base of the cradling member is movable relative to the receiving slot of the receiving member to vary the distance between the first stop wall and the second stop wall.

16. The tool of claim 15, comprising a spring; the receiving slot comprises a rear wall and an entry opening, the rear wall is opposite the entry opening, the spring is positioned between a distal end of the base and the rear wall to bias the first stop wall away from the second stop wall, the distal end of the base is opposite the first stop wall.

* * * * *